US011184715B1

(12) United States Patent
Courtois et al.

(10) Patent No.: US 11,184,715 B1
(45) Date of Patent: Nov. 23, 2021

(54) HEARING DEVICES AND METHODS FOR IMPLEMENTING AN ADAPTIVELY ADJUSTED CUT-OFF FREQUENCY

(71) Applicant: SONOVA AG, Staefa (CH)

(72) Inventors: Gilles Courtois, Uerikon (CH); Julia Rehmann, Uznach (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 17/063,496

(22) Filed: Oct. 5, 2020

(51) Int. Cl.
*H04R 25/00* (2006.01)
*H04R 1/22* (2006.01)

(52) U.S. Cl.
CPC ..... *H04R 25/505* (2013.01); *H04R 1/227* (2013.01); *H04R 2225/43* (2013.01)

(58) Field of Classification Search
CPC .. H04R 25/603; H04R 25/554; H04R 25/652; H04R 2225/021; H04R 2225/41; H04R 2460/11; H04R 25/353; H04R 25/502; G10L 21/205; G10L 21/0232; G10L 21/003; G10L 13/033
See application file for complete search history.

(56) References Cited

U.S. PATENT DOCUMENTS 10,219,727 B2 * 3/2019 Krueger ..... H04R 25/353

FOREIGN PATENT DOCUMENTS

| | | |
|---|---|---|
| AU | 2002300314 | 2/2004 |
| EP | 1441562 | 3/2010 |
| EP | 2304972 | 7/2015 |
| EP | 2369859 | 12/2016 |
| EP | 2724341 | 9/2018 |

OTHER PUBLICATIONS

Rehmann, et al., SoundRecover2—The Adaptive Frequency Compression Algorithm, Phonak Insight, Apr. 2016.

* cited by examiner

*Primary Examiner* — Amir H Etesam
(74) *Attorney, Agent, or Firm* — ALG Intellectual Property, LLC

(57) ABSTRACT

An exemplary hearing device includes a memory storing instructions and a processor communicatively coupled to the memory. The processor may be configured to execute the instructions to receive an input audio signal having a range of input frequencies, adaptively adjust a cut-off frequency for the input audio signal such that a value of the cut-off frequency varies between a predefined minimum cut-off frequency value and a predefined maximum cut-off frequency value as a continuous function of the input audio signal, and generate an output audio signal by mapping the range of input frequencies to a range of output frequencies determined based on the adaptively adjusted cut-off frequency.

20 Claims, 8 Drawing Sheets

HEARING DEVICES AND METHODS FOR IMPLEMENTING AN ADAPTIVELY ADJUSTED CUT-OFF FREQUENCY

BACKGROUND INFORMATION

Hearing devices (e.g., hearing aids) are used to improve the hearing capability and/or communication capability of users. Such hearing devices are configured to process a received input sound signal (e.g., ambient sound) and provide the processed input sound signal to the user (e.g., by way of a receiver (e.g., a speaker) placed in the user's ear canal or at any other suitable location).

Users of hearing devices typically have a hearing loss shape where the hearing loss becomes stronger with increasing frequency. As a result, while low-frequency sounds may still be perceivable, high-frequency sounds may be difficult or impossible for a user to perceive. In addition, due to, for example, physical limitations of a receiver of a hearing device, open fitting configurations, and/or potential feedback, it may not be possible to provide the required amplification to represent such high-frequency sounds to a user. To overcome these problems, one approach is to implement frequency lowering algorithms in which high input audio frequencies are remapped to relatively lower output frequencies where users of hearing devices typically have better residual hearing. However, such frequency lowering algorithms may unnecessarily reserve a portion of available output bandwidth to receive high-frequency compressed content, which may result in significantly compressing original harmonics in an input audio signal and undesired artifacts in an output audio signal.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements.

DETAILED DESCRIPTION

Hearing devices and methods for implementing an adaptively adjusted cut-off frequency are described herein. As will be described in more detail below, an exemplary hearing device comprises a memory storing instructions and a processor communicatively coupled to the memory. The processor may be configured to execute the instructions to receive an input audio signal having a range of input frequencies, adaptively adjust a cut-off frequency for the input audio signal such that a value of the cut-off frequency varies between a predefined minimum cut-off frequency value and a predefined maximum cut-off frequency value as a continuous function of the input audio signal, and generate an output audio signal by mapping the range of input frequencies to a range of output frequencies determined based on the adaptively adjusted cut-off frequency.

By providing hearing devices and methods such as those described herein, it is possible to provide improved sound naturalness and audio quality as compared to conventional frequency lowering methods. For example, hearing devices and methods such as those described herein facilitate ensuring that otherwise inaudible high-frequency sounds and fricatives are made audible while keeping undesirable vowel sound format, harmonics, and/or pitch distortions to a minimum. In addition, hearing devices and methods such as those described herein may result in performing frequency compression with more efficiency in terms of audibility and less artifacts than conventional frequency lowering methods. Moreover, with the hearing devices and methods described herein, a predefined minimum frequency value may be set relatively lower than a minimum frequency value used in conventional frequency lowering methods without increasing a risk of artifacts, which may yield better audibility of high-frequency audio content. Other benefits of the hearing devices and methods described herein will be made apparent herein.

As used herein, a "hearing device" may be implemented by any device configured to provide or enhance hearing to a user. For example, a hearing device may be implemented by a hearing aid configured to amplify audio content to a user, a sound processor included in a cochlear implant system configured to apply electrical stimulation representative of audio content to a user, a sound processor included in a stimulation system configured to apply electrical and acoustic stimulation to a user, or any other suitable hearing prosthesis or combination of hearing prostheses. In some examples, a hearing device may be implemented by a behind-the-ear ("BTE") component configured to be worn behind an ear of a user. In some examples, a hearing device may be implemented by an in-the-ear ("ITE") component configured to at least partially be inserted within an ear canal of a user. In some examples, a hearing device may include a combination of an ITE component, a BTE component, and/or any other suitable component.

Figure 1:
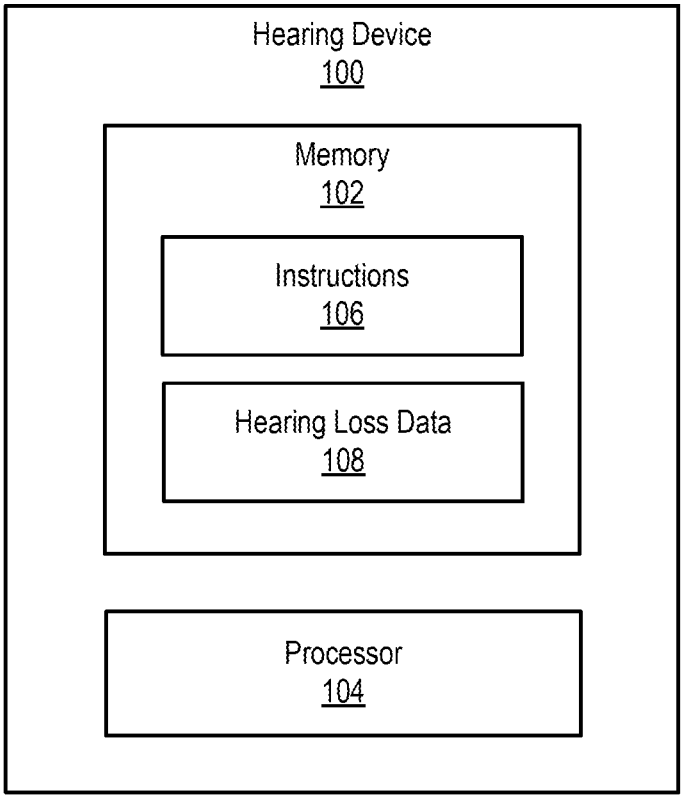
FIG. 1 illustrates an exemplary hearing device according to principles described herein.

FIG. 1 illustrates an exemplary hearing device 100 that may be implemented according to principles described herein. As shown, hearing device 100 may include, without limitation, a memory 102 and a processor 104 selectively and communicatively coupled to one another. Memory 102 and processor 104 may each include or be implemented by hardware and/or software components (e.g., processors, memories, communication interfaces, instructions stored in memory for execution by the processors, etc.).

Memory 102 may maintain (e.g., store) executable data used by processor 104 to perform any of the operations associated with implementing an adaptively adjusted cut-off frequency. For example, memory 102 may store instructions 106 that may be executed by processor 104 to perform any of the operations associated with hearing device 100 described herein. Instructions 106 may be implemented by any suitable application, software, code, and/or other executable data instance.

Memory 102 may also maintain any data received, generated, managed, used, and/or transmitted by processor 104. For example, memory 102 may maintain hearing loss data 108 that may be representative of any information associated with a hearing loss profile of a user of hearing device 100, predefined maximum cut-off frequency values, predefined minimum cut-off frequency values, and/or any other suitable information. In addition, memory 102 may maintain any data suitable to facilitate communications (e.g., wired and/or wireless communications) between hearing device 100 and one or more additional computing devices, such as those described herein. Memory 102 may maintain additional or alternative data in other implementations.

Processor 104 is configured to perform any suitable processing operation that may be associated with hearing device 100 such as by representing audio content to a user of hearing device 100. For example, when hearing device 100 corresponds to a hearing aid device, such processing operations may include monitoring ambient sound and/or representing sound to a user via an in-ear receiver. In examples where hearing device 100 is included as part of a cochlear implant system, such processing operations may include directing a cochlear implant to generate and apply electrical stimulation representative of one or more audio signals (e.g., one or more audio signals detected by a microphone, input by way of an auxiliary audio input port, etc.) to one or more stimulation sites associated with an auditory pathway (e.g., the auditory nerve) of a user.

Processor 104 may be configured to perform (e.g., execute instructions 106 stored in memory 102 to perform) various processing operations associated with implementing an adaptively adjusted cut-off frequency. Such processing operations may include receiving an input audio signal having a range of input frequencies, adaptively adjusting a cut-off frequency for the input audio signal such that a value of the cut-off frequency varies between a predefined minimum cut-off frequency value and a predefined maximum cut-off frequency value as a continuous function of the input audio signal, and generating an output audio signal by mapping the range of input frequencies to a range of output frequencies determined based on the adaptively adjusted cut-off frequency. These and other operations that may be performed by hearing device 100 are described herein.

Figure 2:
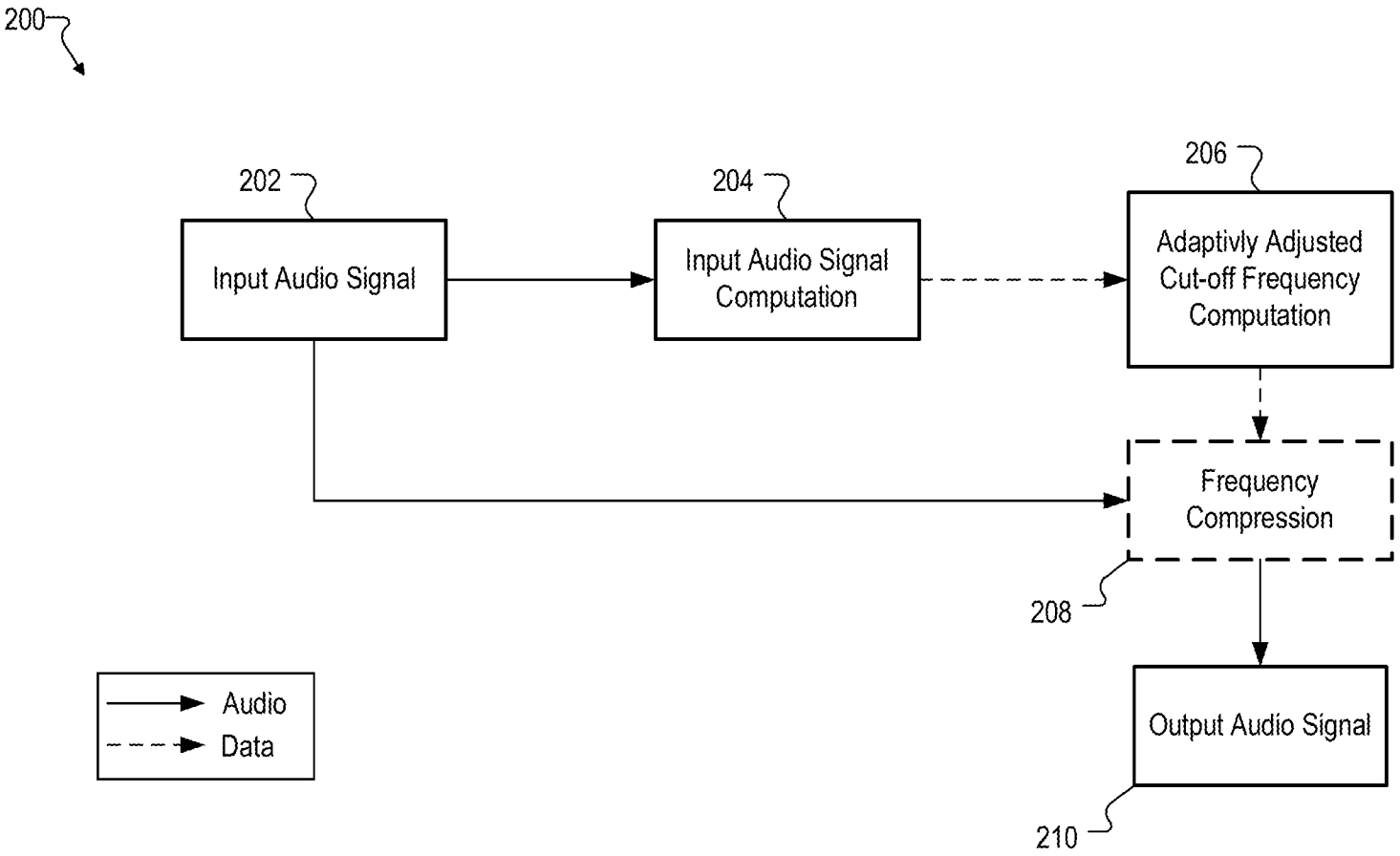
FIG. 2 illustrates an exemplary flowchart showing operations that may be performed by the hearing device of FIG. 1 according to principles described herein.

FIG. 2 shows an exemplary flowchart 200 that depicts operations that may be performed by hearing device 100 (e.g., processor 104) according to principles described herein. As shown in FIG. 2, hearing device 100 may receive an input audio signal at operation 202. Hearing device 100 may receive the input audio signal in any suitable manner. For example, hearing device 100 may receive the input audio signal as ambient sound captured by a microphone included as part of or otherwise communicatively connected to hearing device 100. In certain alternative implementations, hearing device 100 may receive the input audio signal from an external computing device (e.g., a smartphone, a tablet computer, a desktop computer, etc.) by way of any suitable wired or wireless communication protocol (e.g., Bluetooth, Wi-Fi, etc.).

At operation 204, hearing device 100 may perform an input audio signal computation to process the input audio signal to facilitate adaptively adjusting a cut-off frequency of the input audio signal. Hearing device may perform any suitable processing operation or combination of processing operations as may serve a particular implementation. For example, in certain implementations, hearing device 100 may transform the input audio signal from a time domain to a frequency domain by applying a transformation function to obtain an input spectrum having a range of input frequencies.

At operation 206, hearing device 100 may perform a computation to adaptively adjust a cut-off frequency for the input audio signal. This may be accomplished in any suitable manner. For example, hearing device 100 may adaptively adjust a cut-off frequency for the input audio signal such that a value of the cut-off frequency varies between a predefined minimum cut-off frequency value and a predefined maximum cut-off frequency value as a continuous function of the input audio signal. The predefined minimum cut-off frequency value may correspond to any suitable fixed value that is sufficient to preserve low frequency vowel structures of the input audio signal. The predefined maximum cut-off frequency value may correspond to any suitable fixed maximum output frequency value that represents an upper limit of the remaining hearing bandwidth of a particular user of hearing device 100. No output audio content may be provided above the predefined maximum cut-off frequency value because the particular user of hearing device 100 may have no ability to perceive the output audio content and/or the gain required to provide output audio content may be excessively high. In certain examples, the particular values for the predefined minimum cut-off frequency value and the predefined maximum cut-off frequency value may be user specific and may be determined in any suitable manner (e.g., based on hearing loss data 108 stored by memory 102).

Figure 3:
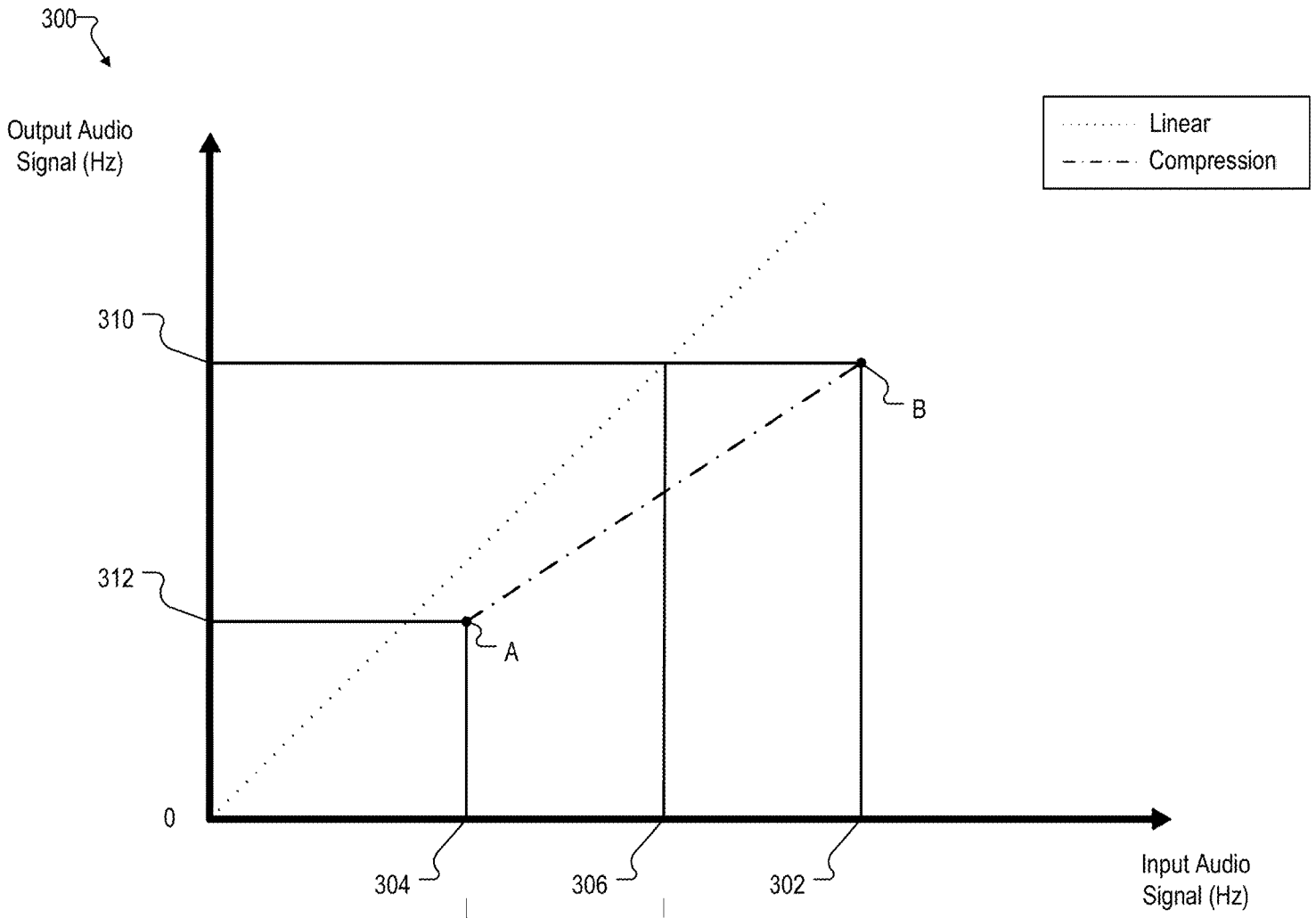
FIG. 3 illustrates an exemplary graph showing a range of an adaptively adjusted cut-off frequency according to principles described herein.

FIG. 3 shows an exemplary graph 300 that depicts a range in which an adaptively adjusted cut-off frequency may vary. As shown in FIG. 3, a frequency range of an input audio signal is represented on the x-axis and a frequency range of an output audio signal is represented on the y-axis. As shown in FIG. 3, the input audio signal includes a range of frequencies from 0 Hz to an upper frequency value 302. The input audio signal shown in FIG. 3 includes predefined minimum cut-off frequency value 304 and a predefined maximum cut-off frequency value 306. Hearing device 100 is configured to adaptively adjust the cut-off frequency within a frequency range 308 such that the cut-off frequency may have a value corresponding to predefined minimum cut-off frequency value 304, predefined maximum cut-off frequency value 306, or any value therebetween depending on the input audio signal.

The output audio signal along the y-axis in FIG. 3 has a frequency range from 0 Hz to a maximum output frequency 310. As shown in FIG. 3, a minimum output frequency 312 is provided along the frequency range of the output audio signal. Minimum output frequency 312 may be associated with an output frequency at which frequency compression may occur.

Returning to FIG. 2, in certain examples, hearing device 100 may, based on the adaptively adjusted cut-off frequency, apply frequency compression to the input audio signal at operation 208. This may be accomplished in any suitable manner. For example, in certain implementations, hearing device 100 may apply a fixed frequency compression ratio to modify the range of input frequencies of the input audio signal. Hearing device 100 may calculate the fixed compression ratio in any suitable manner. For example, hearing device 100 may calculate the fixed compression ratio by calculating a point A and a point B shown in FIG. 3. Point A has the coordinates of predefined minimum cut-off frequency value 304 and minimum output frequency 312. Point B has the coordinates of upper frequency value 302 and maximum output frequency 310. In such an example, the fixed compression ratio may correspond to the inverse value of the slope of the line extending from point A to point B (i.e., compression ratio=1/(slope of A to B)).

At operation 210, hearing device 100 may generate an output audio signal by mapping the range of input frequencies to a range of output frequencies determined based on the adaptively adjusted cut-off frequency. Hearing device 100 may map the range of input frequencies to the range of output frequencies in any suitable manner. For example, hearing device 100 may replace at least some of the frequency components in the range of output frequencies with at least some of the frequency components in the range of input frequencies. Additionally or alternatively, hearing device 100 may combine at least some of the frequency components in the range of output frequencies with at least some of the frequency components in the range of input frequencies. In examples in which hearing device 100 applies a fixed frequency compression ratio, operation 210 may include mapping the range of input frequencies, as modified based on the fixed compression ratio, to the range of output frequencies. In certain examples, the mapping of the range of input frequencies to the range of output frequencies may include nonlinear frequency compression where lower frequencies may be unprocessed while higher frequencies may be compressed in greater amounts.

The output audio signal generated at operation 210 may be represented to a user of hearing device 100 in any suitable manner. For example, hearing device 100 may provide the output audio signal to a receiver (e.g., a speaker) placed in the user's ear canal or at any other suitable location.

In certain examples, hearing device 100 may adaptively adjust the cut-off frequency as a continuous function of an instantaneous input bandwidth of the input audio signal. The instantaneous input bandwidth of the input audio signal may be defined in any suitable manner. For example, the instantaneous input bandwidth of the input audio signal may be defined as a frequency associated with a first bin index of a particular input frame of the input audio signal that reaches a predefined percentage of a total energy of the particular input frame of the input audio signal. In certain examples, the predefined percentage may be equal to or greater than ninety percent of the total energy of the particular input frame.

Figure 4:
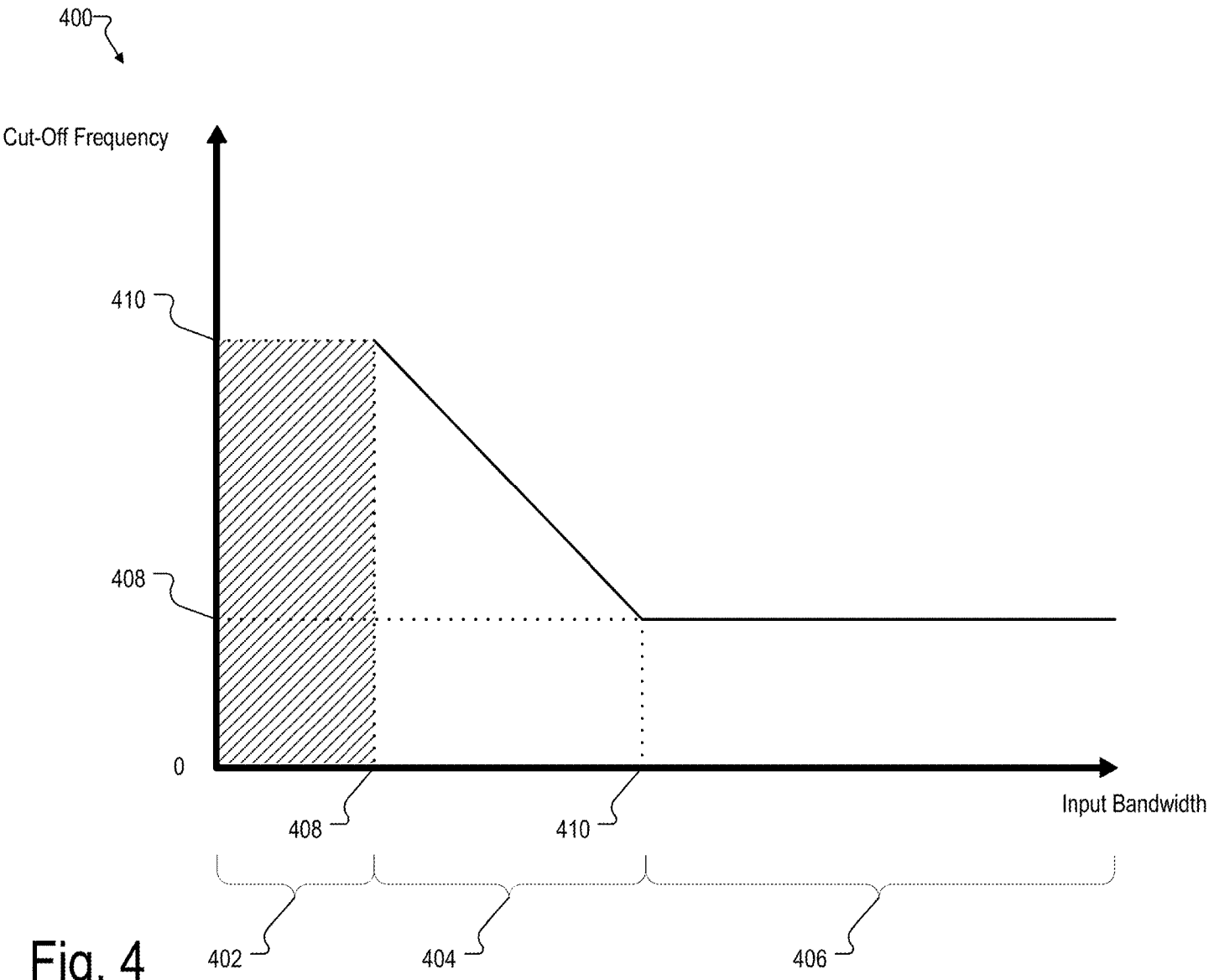
FIG. 4 illustrates an exemplary graph showing how an adaptively adjusted cut-off frequency may change as a function of an instantaneous input bandwidth of an input audio signal according to principles described herein.

FIG. 4 shows an exemplary graph 400 that depicts how a value of an adaptively adjusted cut-off frequency may change within a plurality of different frequency ranges 402, 404, and 406 as a function of the instantaneous input bandwidth. As shown in FIG. 4, frequency range 402 corresponds to a region where the instantaneous input bandwidth of the input audio signal is less than or equal to a predefined minimum cut-off frequency value 408. This may occur when most of the energy of the input audio signal is in low frequencies (e.g., by having vowel sounds). While the instantaneous input bandwidth is within frequency range 402, hearing device 100 may be configured to set the cut-off frequency to a predefined maximum cut-off frequency value 410. In so doing, in frequency range 402, no frequency compression is applied to the input audio signal during the mapping of the range of input frequencies to the range of output frequencies.

Frequency range 404 corresponds to a region where the instantaneous input bandwidth is between predefined minimum cut-off frequency value 408 and a predefined maximum cut-off frequency value 410. As shown in FIG. 4, while the instantaneous input bandwidth is within frequency range 404, hearing device 100 is configured to decrease the adaptively adjusted cut-off frequency as the instantaneous input bandwidth increases. In so doing, the adaptively adjusted cut-off frequency may vary within frequency range 404 depending on the instantaneous input bandwidth of the input audio signal.

Frequency range 406 corresponds to a region where the instantaneous input bandwidth is greater than predefined maximum cut-off frequency value 410. In such examples in which the instantaneous input bandwidth is above predefined maximum cut-off frequency value 410, hearing device 100 is configured to set the adaptively adjusted cut-off frequency to predefined minimum cut-off frequency value 408.

Figure 5C:
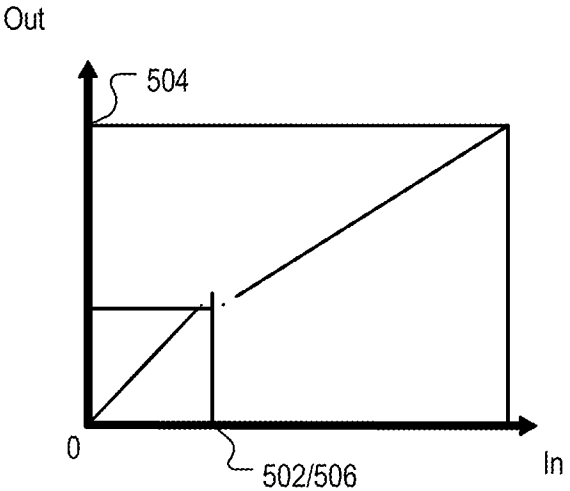
FIGS. 5A-5C illustrate exemplary graphs showing changes in an adaptively adjusted cut-off frequency at various stages shown in FIG. 4 according to principles described herein.
Figure 5B:
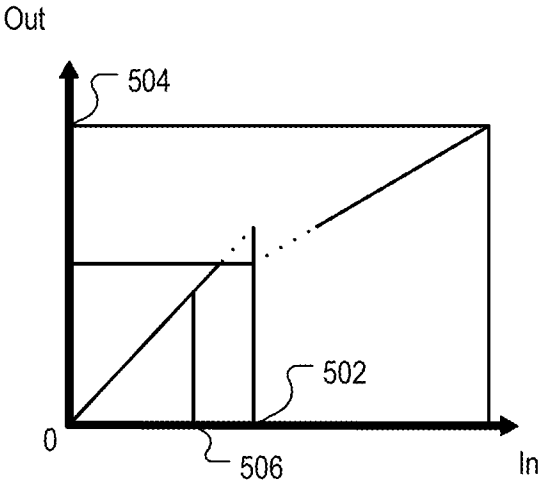
Figure 5A:
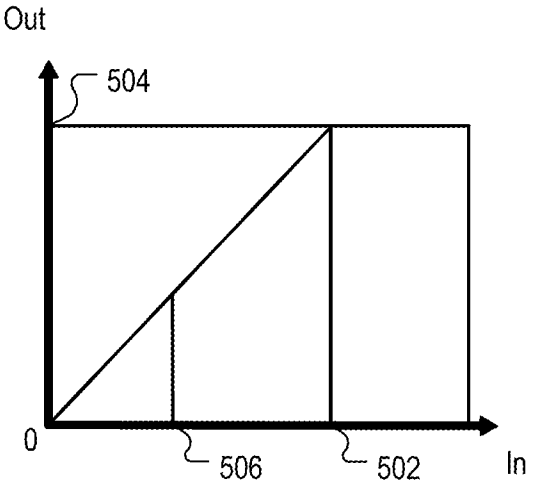

FIGS. 5A-5C show exemplary graphs that depict the adaptively adjusted cut-off frequency while the instantaneous input bandwidth is within each of the frequency ranges 402, 404, and 406 shown in FIG. 4. In the graph shown in FIG. 5A, the instantaneous input bandwidth is within frequency range 402 shown in FIG. 4. In view of this, hearing device 100 sets an adaptively adjusted cut-off frequency 502 to a value that corresponds to a predefined maximum frequency value 504 and the input audio content between 0 Hz and adaptively adjusted cut-off frequency 502 is mapped to the output audio signal with no modification (e.g., fully linear). In so doing, it is possible to prevent artifacts from being introduced into the output audio signal and maximize sound quality.

In the graph shown in FIG. 5B, the instantaneous input bandwidth is within frequency range 404 shown in FIG. 4. In view of this, adaptively adjusted cut-off frequency 502 is between predefined maximum frequency value 504 and a predefined minimum frequency value 506. In such an example, the input audio signal is broadband and adaptively adjusted cut-off frequency 502 linearly decreases with increasing bandwidth of the instantaneous input bandwidth. In so doing, a relatively larger area of the range of frequencies of the output audio signal may be devoted to receive high-frequency compressed content.

In the graph shown in FIG. 5C, the instantaneous input bandwidth is within frequency range 406 shown in FIG. 4. In such an example, a significant part of the energy of the input audio signal may be located in the high frequencies due to, for example, fricative consonants being present in the input audio signal. As such, adaptively adjusted cut-off frequency 502 is set in FIG. 5C to predefined minimum frequency value 506. With such a configuration, a relatively larger amount of output frequency (e.g., between the minimum output frequency and the maximum output frequency) is devoted to receive high-frequency compressed content.

In certain implementations, hearing device 100 may implement an adaptive frequency compression ratio instead of a fixed frequency compression ratio. For example, hearing device 100 may implement an input bandwidth-dependent frequency compression ratio to modify the range of frequencies of the input audio signal. In such examples, the compression ratio may operate in a manner similar to that shown in FIG. 5A if the instantaneous input bandwidth is less than or equal to predefined minimum frequency value 408 shown in FIG. 4. That is, in such an example, no frequency compression may be applied to the input audio signal while mapping the range of frequencies of the input audio signal to the range of output frequencies of the output audio signal. However, if the instantaneous input bandwidth is between predefined minimum frequency value 408 and predefined maximum cut-off frequency value 410, the adaptively adjusted cut-off frequency may be computed as shown in FIG. 4 and an adaptive frequency compression ratio may be implemented that decreases as the instantaneous input bandwidth increases. If, on the other hand, the instantaneous input bandwidth is greater than predefined maximum cut-off frequency value 410 shown in FIG. 4, then the frequency compression ratio may be fixed and may be determined in any suitable manner. For example, the fixed frequency compression ratio (CR) in such an example may equal:

$$CR = \frac{Fs - 2F\min}{2(FOutMax - F\min)}$$

Where Fs=the upper frequency of the input audio signal; Fmin=the predefined minimum cut-off frequency value; and FOutMax=the maximum output frequency of the output audio signal.

In examples in which hearing device 100 applies an adaptive frequency compression ratio (e.g., an input bandwidth-dependent frequency compression ratio), hearing device 100 may map the range of input frequencies of an input audio signal, as modified based on the adaptive frequency compression ratio, to the range of output frequencies of the output audio signal.

In certain examples, hearing device 100 may adaptively adjust the cut-off frequency as a continuous function of an instantaneous input level of the input audio signal. Hearing device 100 may use the instantaneous input level of the input audio signal in any suitable manner to adaptively adjust the cut-off frequency. For example, hearing device 100 may use the instantaneous input level in a manner similar to the instantaneous input bandwidth such as described herein.

In certain examples, hearing device 100 may implement a pre-compensation filter to mitigate low-frequency masking of an output audio signal. The spread of masking by low frequencies to high frequencies becomes larger at relatively higher input levels. For example, high frequencies that would not be masked by a low-frequency sound at a level of 50 dB sound pressure level (SPL) may be masked by the same masker at 80 dB SPL. To mitigate this, hearing device 100 may determine and apply a pre-compensation filter to an input audio signal. Such a pre-compensation filter may correspond to an adaptive pre-compensation filter that takes into account an overall SPL in an environment surrounding hearing device 100 as well as a balance between low-frequency and high-frequency energies of the input audio signal. Hearing device 100 may determine the pre-compensation filter in any suitable manner. To illustrate an example, a pre-compensation filter may take as input the SPL derived in bark bands $E_{bark}$, which is a 20×1 vector. The broadband SPL $E_{BB}$ may be defined as:

$$E_{BB}=\max\{E_{Bark}(1:8)\}$$

which corresponds to the maximum SPL between 172 Hz and 1378 Hz.

If $E_{BB}>E_{max}$ (where $E_{max}$ is typically 80 dB SPL), $E_{BB}$ may be set to $E_{max}$. If $E_{BB}<E_{min}$ (where $E_{min}$ is typically 50 dB SPL), no pre-compensation filter is applied.

If $E_{BB}\geq E_{min}$, three slopes $\delta_i$ are computed as:

$$\begin{cases} \delta_1 = \dfrac{\min\{0,\ E_{Bark}(2) - E_{Bark}(1)\}}{E_{max} - E_{min}} \\ \delta_2 = \dfrac{\min\{0,\ E_{Bark}(4) - E_{Bark}(2)\}}{E_{max} - E_{min}} \\ \delta_3 = \dfrac{\min\{0,\ E_{Bark}(8) - E_{Bark}(4)\}}{E_{max} - E_{min}} \end{cases}$$

In the above expression, $\delta_1$ may be associated with a frequency range of 172-347 Hz, $\delta_2$ may be associated with a frequency range of 347-689 Hz, and $\delta_3$ may be associated with a frequency range of 689-1378 Hz.

Three intercepts $\beta_i$ may be computed as:

$$\begin{cases} \beta_1 = -\delta_1 E_{min} \\ \beta_2 = -\delta_2 E_{min} \\ \beta_3 = -\delta_3 E_{min} \end{cases}$$

Three coefficients $\gamma_i$ may be computed as:

$$\begin{cases} \gamma_1 = \delta_1 E_{BB} + \beta_1 \\ \gamma_2 = \delta_2 E_{BB} + \beta_2 \\ \gamma_3 = \delta_3 E_{BB} + \beta_3 \end{cases}$$

A 64×1 vector C containing frequency domain gains of the pre-compensation filter expressed in dB may be initialized with zeros. The coefficients associated to the frequency bins between 172 Hz (bin index #2) and 1378 (bin index #8) may be derived as:

$$\begin{cases} C(2) = \gamma_1 + \gamma_2 + \gamma_3 \\ C(3) = \gamma_2 + \gamma_3 \\ C(4) = 0.5 \times \gamma_2 + \gamma_3 \\ C(5) = \gamma_3 \\ C(6) = 0.75 \times \gamma_3 \\ C(7) = 0.5 \times \gamma_3 \\ C(8) = 0.25 \times \gamma_3 \end{cases}$$

The above expressions associated with determining a pre-compensation filter are provided for illustrative purposes only. It is understood that a pre-compensation filter may be determined in any other suitable manner as may serve a particular implementation.

Figure 6:
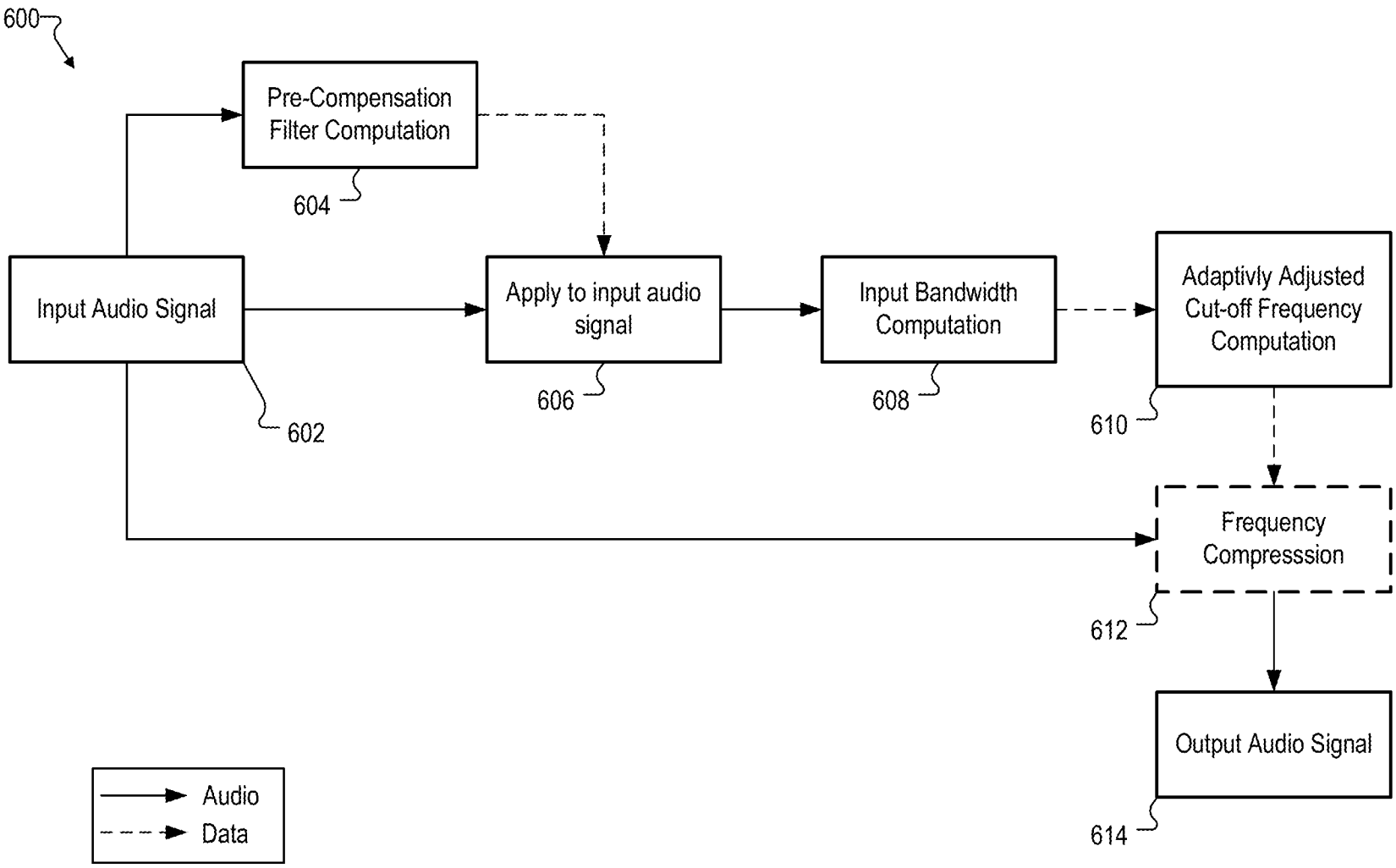
FIG. 6 illustrates another exemplary flowchart showing operations that may be performed by the hearing device of FIG. 1 according to principles described herein.

FIG. 6 illustrates an exemplary flowchart 600 in which a pre-compensation filter may be applied to an input audio signal. As shown in FIG. 6, hearing device 100 may receive an input audio signal at operation 602. This may be accomplished in any suitable manner such as described herein.

At operation 604, hearing device 100 may perform a pre-compensation filter computation. This may be accomplished in any suitable manner such as described herein.

In certain examples, prior to performing operation 604, hearing device 100 may perform one or more additional processing operations on the input audio signal. For example, hearing device 100 may perform a bin to bark conversion, a computation of the SPL in bark, and/or any other suitable processing operation.

At operation 606, hearing device 100 may apply the computed pre-compensation filter to the input audio signal. This may be accomplished in any suitable manner.

At operation 608, hearing device 100 may perform an input bandwidth computation on the input audio signal as adjusted by the pre-compensation filter. This may be accomplished in any suitable manner such as described herein.

At operation 610, hearing device 100 may perform an adaptively adjusted cut-off frequency computation. This may be accomplished in any suitable manner such as described herein.

At operation 612, hearing device 100 may perform a frequency compression operation. As described herein, whether hearing device 100 performs frequency compression may depend on the input audio signal. For example, if the instantaneous input bandwidth of the input audio signal is equal to or less than a predefined minimum frequency value, hearing device 100 may not perform operation 612 on the input audio signal.

At operation 614, hearing device 100 may generate an output audio signal based on the audio signals and/or data received, generated, etc. at operations 602-612.

Figure 7:
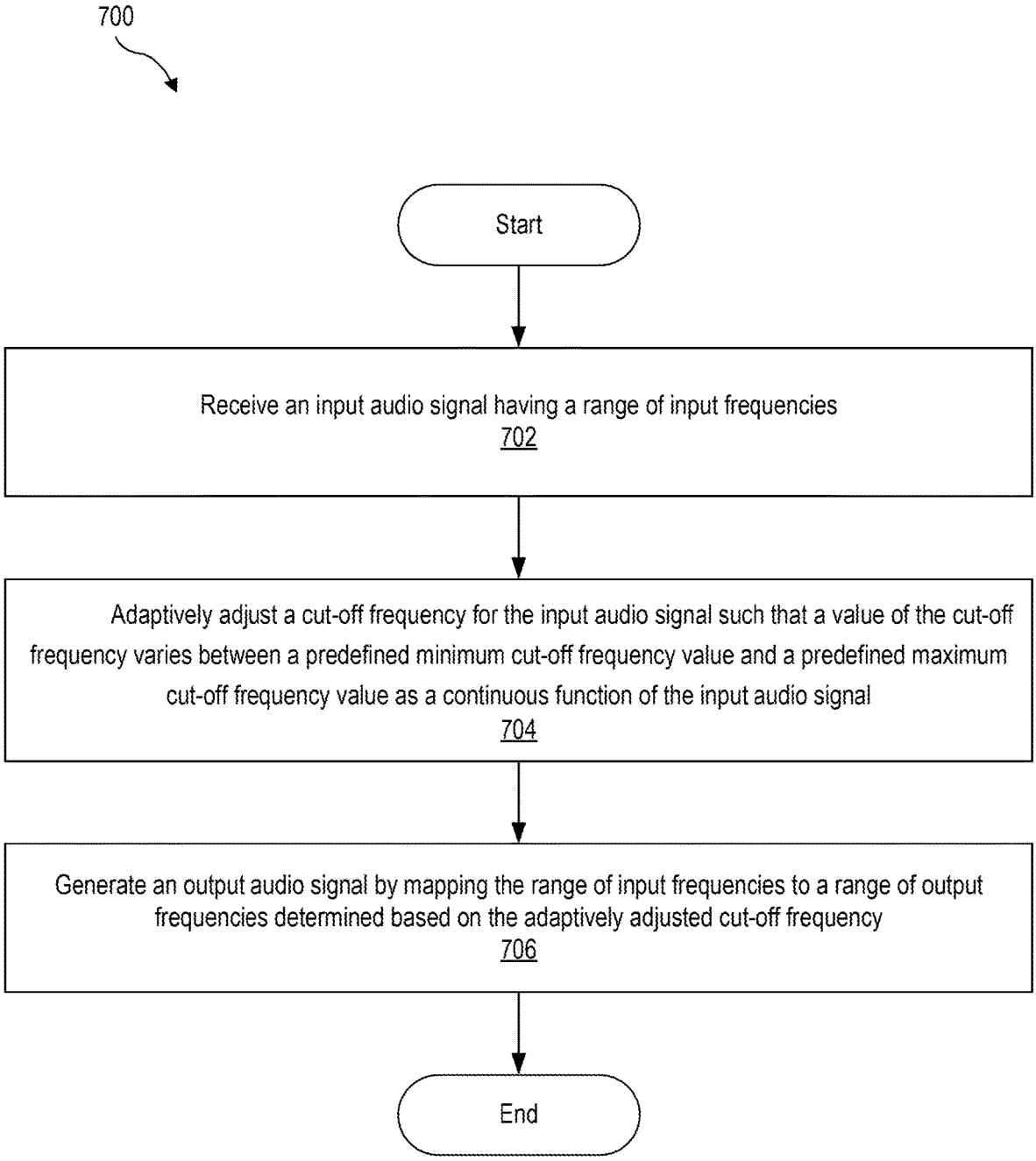
FIG. 7 illustrates an exemplary method for implementing an adaptively adjusted cut-off frequency according to principles described herein.

FIG. 7 illustrates an exemplary method 700 for implementing an adaptively adjusted cut-off frequency. While FIG. 7 illustrates exemplary operations according to one embodiment, other embodiments may omit, add to, reorder, and/or modify any of the operations shown in FIG. 7. One or more of the operations shown in FIG. 7 may be performed by a hearing device such as hearing device 100, any components included therein, and/or any implementation thereof.

At operation 702, a processor (e.g., processor 104) may determine, while a hearing device (e.g., hearing device 100) is configured to receive an input audio signal having a range of input frequencies. Operation 702 may be performed in any of the ways described herein.

At operation 704, the processor may adaptively adjust a cut-off frequency for the input audio signal such that a value of the cut-off frequency varies between a predefined minimum cut-off frequency value and a predefined maximum cut-off frequency value as a continuous function of the input audio signal. Operation 704 may be performed in any of the ways described herein.

At operation 706, the processor may generate an output audio signal by mapping the range of input frequencies to a range of output frequencies determined based on the adaptively adjusted cut-off frequency. Operation 706 may be performed in any of the ways described herein.

In some examples, a non-transitory computer-readable medium storing computer-readable instructions may be provided in accordance with the principles described herein. The instructions, when executed by a processor of a computing device, may direct the processor and/or computing device to perform one or more operations, including one or more of the operations described herein. Such instructions may be stored and/or transmitted using any of a variety of known computer-readable media.

A non-transitory computer-readable medium as referred to herein may include any non-transitory storage medium that participates in providing data (e.g., instructions) that may be read and/or executed by a computing device (e.g., by a processor of a computing device). For example, a non-transitory computer-readable medium may include, but is not limited to, any combination of non-volatile storage media and/or volatile storage media. Exemplary non-volatile storage media include, but are not limited to, read-only memory, flash memory, a solid-state drive, a magnetic storage device (e.g. a hard disk, a floppy disk, magnetic tape, etc.), ferroelectric random-access memory ("RAM"), and an optical disc (e.g., a compact disc, a digital video disc, a Blu-ray disc, etc.). Exemplary volatile storage media include, but are not limited to, RAM (e.g., dynamic RAM).

Figure 8:
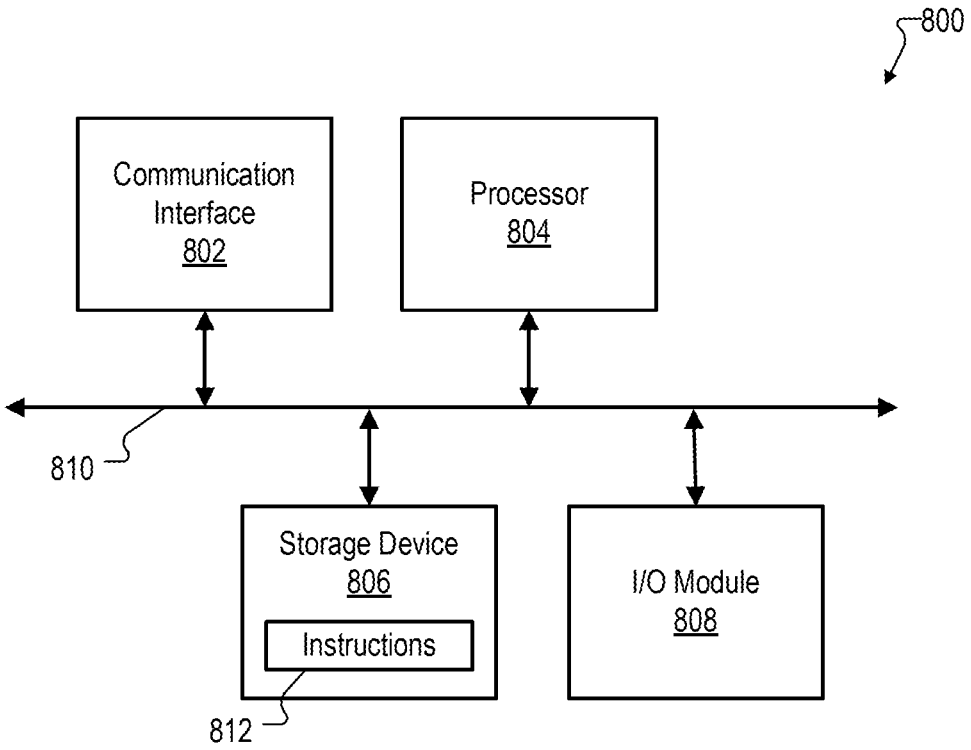
FIG. 8 illustrates an exemplary computing device according to principles described herein.

FIG. 8 illustrates an exemplary computing device 800 that may be specifically configured to perform one or more of the processes described herein. As shown in FIG. 8, computing device 800 may include a communication interface 802, a processor 804, a storage device 806, and an input/output ("I/O") module 808 communicatively connected one to another via a communication infrastructure 810. While an exemplary computing device 800 is shown in FIG. 8, the components illustrated in FIG. 8 are not intended to be limiting. Additional or alternative components may be used in other embodiments. Components of computing device 800 shown in FIG. 8 will now be described in additional detail.

Communication interface 802 may be configured to communicate with one or more computing devices. Examples of communication interface 802 include, without limitation, a wired network interface (such as a network interface card), a wireless network interface (such as a wireless network interface card), a modem, an audio/video connection, and any other suitable interface.

Processor 804 generally represents any type or form of processing unit capable of processing data and/or interpreting, executing, and/or directing execution of one or more of the instructions, processes, and/or operations described herein. Processor 804 may perform operations by executing computer-executable instructions 812 (e.g., an application, software, code, and/or other executable data instance) stored in storage device 806.

Storage device 806 may include one or more data storage media, devices, or configurations and may employ any type, form, and combination of data storage media and/or device. For example, storage device 806 may include, but is not limited to, any combination of the non-volatile media and/or volatile media described herein. Electronic data, including data described herein, may be temporarily and/or permanently stored in storage device 806. For example, data representative of computer-executable instructions 812 configured to direct processor 804 to perform any of the operations described herein may be stored within storage device 806. In some examples, data may be arranged in one or more databases residing within storage device 806.

I/O module 808 may include one or more I/O modules configured to receive user input and provide user output. I/O module 808 may include any hardware, firmware, software, or combination thereof supportive of input and output capabilities. For example, I/O module 808 may include hardware and/or software for capturing user input, including, but not limited to, a keyboard or keypad, a touchscreen component (e.g., touchscreen display), a receiver (e.g., an RF or infrared receiver), motion sensors, and/or one or more input buttons.

I/O module 808 may include one or more devices for presenting output to a user, including, but not limited to, a graphics engine, a display (e.g., a display screen), one or more output drivers (e.g., display drivers), one or more audio speakers, and one or more audio drivers. In certain embodiments, I/O module 808 is configured to provide graphical data to a display for presentation to a user. The graphical data may be representative of one or more graphical user interfaces and/or any other graphical content as may serve a particular implementation.

In some examples, any of the systems, hearing devices, and/or other components described herein may be implemented by computing device 800. For example, memory 102 may be implemented by storage device 806, and processor 104 may be implemented by processor 804.

In the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A hearing device comprising:

a memory storing instructions; and a processor communicatively coupled to the memory and configured to execute the instructions to:

receive an input audio signal having a range of input frequencies;

adaptively adjust a cut-off frequency for the input audio signal such that a value of the cut-off frequency varies between a predefined minimum cut-off frequency value and a predefined maximum cut-off frequency value as a continuous function of the input audio signal; and generate an output audio signal by mapping the range of input frequencies to a range of output frequencies determined based on the adaptively adjusted cut-off frequency.

2. The hearing device of claim 1, wherein the adaptively adjusting of the cut-off frequency as the continuous function of the input audio signal includes adaptively adjusting the cut-off frequency as a continuous function of an instantaneous input bandwidth of the input audio signal.

3. The hearing device of claim 2, wherein, when the instantaneous input bandwidth of the input audio signal is less than the predefined minimum cut-off frequency value, no frequency compression is applied to the input audio signal during the mapping.

4. The hearing device of claim 2, wherein the processor is further configured to execute the instructions to:

apply, when the instantaneous input bandwidth of the input audio signal is between the predefined minimum cut-off frequency value and the predefined maximum cut-off frequency value, a fixed frequency compression ratio to modify the range of frequencies of the input audio signal, wherein the generating of the output audio signal includes mapping the range of input frequencies, as modified based on the fixed frequency compression ratio, to the range of output frequencies.

5. The hearing device of claim 2, wherein the processor is further configured to execute the instructions to:

apply, when the instantaneous input bandwidth of the input audio signal is between the predefined minimum cut-off frequency value and the predefined maximum cut-off frequency value, an input bandwidth-dependent frequency compression ratio to modify the range of frequencies of the input audio signal, wherein the generating of the output audio signal includes mapping the range of input frequencies, as modified based on the input bandwidth-dependent frequency compression ratio, to the range of output frequencies.

6. The hearing device of claim 2, wherein, when the instantaneous input bandwidth of the input audio signal is between the predefined minimum cut-off frequency value and the predefined maximum cut-off frequency value, the adaptively adjusted cut-off frequency decreases as the instantaneous input bandwidth increases.

7. The hearing device of claim 2, wherein, when the instantaneous input bandwidth is above the predefined maximum cut-off frequency value, the cut-off frequency is set to the predefined minimum cut-off frequency value.

8. The hearing device of claim 2, wherein the instantaneous input bandwidth of the input audio signal is defined as a frequency associated with a first bin index of a particular input frame of the input audio signal that reaches a predefined percentage of a total energy of the particular input frame of the input audio signal.

9. The hearing device of claim 8, wherein the predefined percentage is equal to or greater than ninety percent of the total energy of the particular input frame of the input audio signal.

10. The hearing device of claim 1, wherein the adaptively adjusting of the cut-off frequency as the continuous function of the input audio signal includes adaptively adjusting the cut-off frequency as a continuous function of an instantaneous input level of the input audio signal.

11. The hearing device of claim 1, wherein the processor is further configured to execute the instructions to apply a pre-compensation filter to the input audio signal to mitigate low frequency masking of the output audio signal.

12. The hearing device of claim 1, wherein the processor is further configured to execute the instructions to provide the output audio signal to a receiver configured to represent the output audio signal to a user of the hearing device.

13. A method comprising:

receiving, by a processor of a hearing device, an input audio signal having a range of input frequencies;

adaptively adjusting, by the processor of the hearing device, a cut-off frequency for the input audio signal such that a value of the cut-off frequency varies between a predefined minimum cut-off frequency value and a predefined maximum cut-off frequency value as a continuous function of the input audio signal; and generating, by the processor of the hearing device, an output audio signal by mapping the range of input frequencies to a range of output frequencies determined based on the adaptively adjusted cut-off frequency.

14. The method of claim 13, wherein the adaptively adjusting of the cut-off frequency as the continuous function of the input audio signal includes adaptively adjusting the cut-off frequency as a continuous function of an instantaneous input bandwidth of the input audio signal.

15. The method of claim 14, further comprising applying, by the processor of the hearing device when the instantaneous input bandwidth of the input audio signal is between the predefined minimum cut-off frequency value and the predefined maximum cut-off frequency value, a fixed frequency compression ratio to modify the range of frequencies of the input audio signal, wherein the generating of the output audio signal includes mapping the range of input frequencies, as modified based on the fixed frequency compression ratio, to the range of output frequencies.

16. The method of claim 14, further comprising applying, by the processor of the hearing device when the instantaneous input bandwidth of the input audio signal is between the predefined minimum cut-off frequency value and the predefined maximum cut-off frequency value, an input bandwidth-dependent frequency compression ratio to modify the range of frequencies of the input audio signal, wherein the generating of the output audio signal includes mapping the range of input frequencies, as modified based on the input bandwidth-dependent frequency compression ratio, to the range of output frequencies.

17. The method of claim 14, wherein the instantaneous input bandwidth of the input audio signal is defined as a frequency associated with a first bin index of a particular input frame of the input audio signal that reaches a predefined percentage of a total energy of the particular input frame of the input audio signal.

18. The hearing device of claim 17, wherein the predefined percentage is equal to or greater than ninety percent of the total energy of the particular input frame of the input audio signal.

19. The method of claim 13, further comprising applying, by the processor of the hearing device, a pre-compensation filter to the input audio signal to mitigate low frequency masking of the output audio signal.

20. A non-transitory computer readable storage medium storing instructions that, when executed, direct a processor of a hearing device to:

receive an input audio signal having a range of input frequencies;

adaptively adjust a cut-off frequency for the input audio signal such that a value of the cut-off frequency varies between a predefined minimum cut-off frequency value and a predefined maximum cut-off frequency value as a continuous function of the input audio signal; and generate an output audio signal by mapping the range of input frequencies to a range of output frequencies determined based on the adaptively adjusted cut-off frequency.

* * * * *